US006057028A

United States Patent [19]

Tan et al.

[11] Patent Number: 6,057,028

[45] **Date of Patent: *May 2, 2000**

[54] MULTILAYERED THERMAL TRANSFER MEDIUM FOR HIGH SPEED PRINTING

[75] Inventors: Yaoping Tan, Miamisburg; Thomas C. Miller, Jr., Kettering; Thomas J. Obringer, Vandalia, all of Ohio

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/719,045

[22] Filed: Sep. 24, 1996

[51] Int. Cl.[7] ..... B41M 5/26

[52] U.S. Cl. ..... 428/212; 428/195; 428/480; 428/484; 428/488.1; 428/488.4; 428/913; 428/914

[58] Field of Search ..... 428/195, 484, 428/488.1, 488.4, 480, 522, 500, 212, 913, 914

[56] References Cited

U.S. PATENT DOCUMENTS

| | | | |
|---|---|---|---|
| 3,663,278 | 5/1972 | Blose et al. . | |
| 4,315,643 | 2/1982 | Tokunaga et al. . | |
| 4,403,224 | 9/1983 | Wirnowski . | |
| 4,523,207 | 6/1985 | Lewis . | |
| 4,567,113 | 1/1986 | Ohtsu et al. | 428/488.4 |
| 4,628,000 | 12/1986 | Talvalkar et al. . | |
| 4,687,701 | 8/1987 | Knirsch et al. . | |
| 4,698,268 | 10/1987 | Ueyama . | |
| 4,707,395 | 11/1987 | Ueyama et al. . | |
| 4,777,079 | 10/1988 | Nagamoto et al. . | |
| 4,778,729 | 10/1988 | Mizobuci . | |
| 4,792,495 | 12/1988 | Taniguchi et al. | 428/484 |
| 4,865,901 | 9/1989 | Ohno . | |
| 4,869,941 | 9/1989 | Ohki . | |
| 4,894,283 | 1/1990 | Wehr . | |
| 4,923,749 | 5/1990 | Talvalkar . | |
| 4,975,332 | 12/1990 | Shini et al. . | |
| 4,983,446 | 1/1991 | Taniguchi et al. . | |
| 4,988,563 | 1/1991 | Wehr . | |
| 5,053,267 | 10/1991 | Ide et al. . | |
| 5,128,308 | 7/1992 | Talvalkar . | |
| 5,130,180 | 7/1992 | Koshizuka et al. . | |
| 5,204,189 | 4/1993 | Ueyama et al. . | |
| 5,240,781 | 8/1993 | Obata et al. . | |
| 5,248,652 | 9/1993 | Talvalkar . | |
| 5,266,447 | 11/1993 | Takahashi et al. . | |
| 5,326,622 | 7/1994 | Yamane et al. | 428/488.4 |
| 5,348,348 | 9/1994 | Hanada et al. . | |
| 5,567,506 | 10/1996 | Sogabe | 428/484 |

FOREIGN PATENT DOCUMENTS

| | | |
|---|---|---|
| 0194860 | 9/1986 | European Pat. Off. . |
| 0411924 | 2/1991 | European Pat. Off. . |
| 0673789 | 9/1995 | European Pat. Off. . |
| 3507097 | 9/1985 | Germany . |
| 3634049 | 4/1987 | Germany . |

*Primary Examiner*—Pamela R. Schwartz
*Attorney, Agent, or Firm*—Millen White Zelano & Branigan PC

[57] ABSTRACT

A thermal transfer medium which forms images with high speed thermal transfer printers is provided which comprises a substrate, a first coating comprised of at least 75 wt. % of a wax, a second coating comprising a sensible material such as a pigment and a binder resin with high hot tack properties in an amount of at least 20 wt. % based on total dry components and an optional third coating which does not contain any coloring agent. The first coating has a melt viscosity and cohesion lower than that of the second coating and preferably lower hot tack properties to simplify complete transfer to a receiving substrate. The coating formulation provides high adhesion to a receiving substrate with reduced adhesion to the flexible substrate of the thermal transfer medium, allowing for rapid transfer to a receiving substrate as required with high speed thermal transfer printers.

8 Claims, 1 Drawing Sheet

MULTILAYERED THERMAL TRANSFER MEDIUM FOR HIGH SPEED PRINTING

FIELD OF THE INVENTION

The present invention relates to thermal transfer printing technology wherein data or images are produced on a receiving substrate by selectively transferring portions of a pigmented layer from a donor film to the receiving substrate by heating extremely precise areas with heating elements typically comprised of thin film resistors. More particularly, the present invention relates to thermal transfer printing with high speed printers such as "near edge", "true edge" or "feather edge" thermal transfer printers wherein the thin film resistors (heating elements) are positioned right at the edge of the thermal print head allowing rapid separation of the donor film from the receiving substrate after the thin film resistors are fired.

BACKGROUND OF THE INVENTION

Thermal transfer printing is widely used in special applications such as in the printing of machine readable bar codes, either on labels or directly on articles to be encoded. The thermal transfer process employed by these printing methods provides great flexibility in generating images allowing for broad variations in the style, size and color of the printed images, typically from a single machine with a single thermal print head.

Representative documentation in the area of thermal transfer printing includes the following patents:

U.S. Pat. No. 3,663,278, issued to J. H. Blose et al. on May 16, 1972, which discloses a thermal transfer medium having a coating composition of cellulosic polymer, thermoplastic resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,523,207, issued to M. W. Lewis et al. on Jun. 11, 1985, discloses a multiple copy thermal record sheet which uses crystal violet lactone and a phenolic resin.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama et al. on Nov. 17,1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mizobuchi on Oct. 18, 1988, discloses a heat transfer sheet comprising a hot melt ink layer on one surface of a film and a filling layer laminated on the ink layer.

U.S. Pat. No. 4,865,901, issued to Ohno et al. on Sep. 12,1989, discloses a thermal transfer printing ribbon with an ink layer comprising a blend of ethylene-vinyl acetate copolymer and a viscous resin as a binder with correction/erasability capabilities.

U.S. Pat. No. 4,869,941, issued to Ohki on Sep. 26,1989, discloses an imaged substrate with a protective layer laminated on the imaged surface.

U.S. Pat. No. 4,894,283, issued to Wehr on Jan. 16,1990, discloses a reusable thermal transfer ribbon with a functional layer and a binding layer containing 100% ethylene vinyl acetate copolymer.

U.S. Pat. No. 4,923,749, issued to Talvalkar on May 8,1990, discloses a thermal transfer ribbon which comprises two layers, a thermosensitive layer and a protective layer, both of which are water based.

U.S. Pat. No. 4,975,332, issued to Shini et al. on Dec. 4,1990, discloses a recording medium for transfer printing comprising a base film, an adhesiveness improving layer, an electrically resistant layer and a heat sensitive transfer ink layer.

U.S. Pat. No. 4,983,446, issued to Taniguchi et al. on Jan. 8,1991, describes a thermal image transfer recording medium which comprises as a main component, a saturated linear polyester resin.

U.S. Pat. No. 4,988,563, issued to Wehr on Jan. 29,1991, discloses a thermal transfer ribbon having a thermal sensitive coating and a protective coating. The protective coating is a wax-copolymer mixture which reduces ribbon offset.

U.S. Pat. Nos. 5,128,308 and 5,248,652, issued to Talvalkar, each disclose a thermal transfer ribbon having a reactive dye which generates color when exposed to heat from a thermal transfer printer.

U.S. Pat. No. 5,240,781, issued to Obata et al. on Aug. 31,1993, discloses an ink ribbon for thermal transfer printers having an ink layer with viscosity, softening and solidifying characteristics said to provide clear images on rough paper even with high speed printers.

As the use of thermal transfer printing grows into new applications, the requirements for the ribbons become broader and more strict. For example, providing print with smudge and scratch resistance, chemical resistance and suitability for rough stock (receiving substrates) can require special formulations for the thermal transfer media. The use of printers having heating elements displaced right at the edge of the print head has been favored in that this configuration extends the life of the print head. Such printers are known in the art as "near edge", "true edge" and "feather edge" printers and are referred to herein collectively as "high speed printers" due to the rapid separation of the ribbon from the substrate once the print head heating elements have been fired.

With the advent of high speed printers, modification of conventional thermal transfer ribbons has been found to be necessary. Conventional thermal transfer ribbons do not perform satisfactorily with high speed printers in that the ribbon and receiving substrate are separated almost spontaneously after the thin film resistors are fired and there is very little time for waxes and/or resins to melt/soften and flow onto the surface of the receiving substrate before the ribbon is separated from the receiving substrate. With conventional ribbons, the adhesion of the molten/softened material to the receiving substrate is typically lower than its adhesion to the supporting substrate of the ribbon at the time of separation with a high speed printer. As a result, the functioning thermal transfer layer is usually split and the transfer incomplete, resulting in light printed images where the functioning layer is an ink layer.

The use of an adhesive layer, comprising polycaprolactone and no pigment, on top of a functioning layer is disclosed by Obata et al. in U.S. Pat. No. 5,240,781. Such a configuration has been found not to provide the best offset resistance and darkest density of printed images for other formulations. A new configuration is desired for thermal transfer ribbons which do not require a polycaprolactone adhesive layer and which is more resistant to offset and provides dark density images.

BRIEF SUMMARY OF THE INVENTION

It is an object of the present invention to provide a thermal transfer medium such as a thermal transfer ribbon which produces high quality images with reduced off-set with high speed thermal transfer printers.

It is an additional object of the present invention to provide a thermal transfer medium such as a thermal transfer ribbon which does not comprise polycaprolactone and which produces high quality images with reduced offset with the "near edge", "true edge" or "feather edge" thermal transfer printers and other high speed printers wherein the thermal transfer ribbon is separated from the receiving substrate almost spontaneously after the heating elements of the thermal transfer print head have been fired.

It is a further object of the present invention to provide a thermal transfer medium such as a thermal transfer ribbon which produces high quality images and reduced offset on receiving substrates with rough surfaces (rough stock).

Additional objects and advantages of the present invention will become apparent and further understood from the detailed description and claims which follow, together with the annexed drawings.

The above objects are achieved through a thermal transfer medium of the present invention which transfers images to a receiving substrate when exposed to an operating print head of a thermal transfer printer, wherein the thermal transfer medium comprises a) a flexible substrate; b) a thermosoftenable first coating composition positioned on said substrate and comprising at least 75 wt. % of a wax, preferably a blend, a binder resin and optionally a sensible material; and c) a thermosoftenable second coating positioned on the first coating and comprising a sensible material such as a colored pigment, wax and at least 20 wt. % of a binder resin with high hot tack properties. The first coating and second coating are formulated so that the first coating has a melt viscosity value lower than that of the second coating cohesion and, preferably, a softening point higher than or equal to that of the second coating. With lower melt viscosity comes lower cohesion within the layer, which eases separation of the transferred and untransferred portions of the first coating on the flexible substrate of the ribbon. The 75 wt. % wax in the first coating is based on dry components and the 20 wt. % resin binder with high hot tack properties is also based on dry components. The binder resin with high hot tack properties include ethylene-vinyl acetates, polyurethanes or styrene-butadiene block copolymers. In preferred embodiments, the first coating contains no sensible material, at least 85 wt. % of a wax blend and less than 10 wt. % binder resin to provide a low melt viscosity and low cohesion. Higher softening points are desired for the first coating to provide higher abrasion/smear resistance and also help prevent the layers of coating from melting into each other and thus becoming one layer during the drying process.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED SUMMARY OF THE INVENTION

Figure 1:
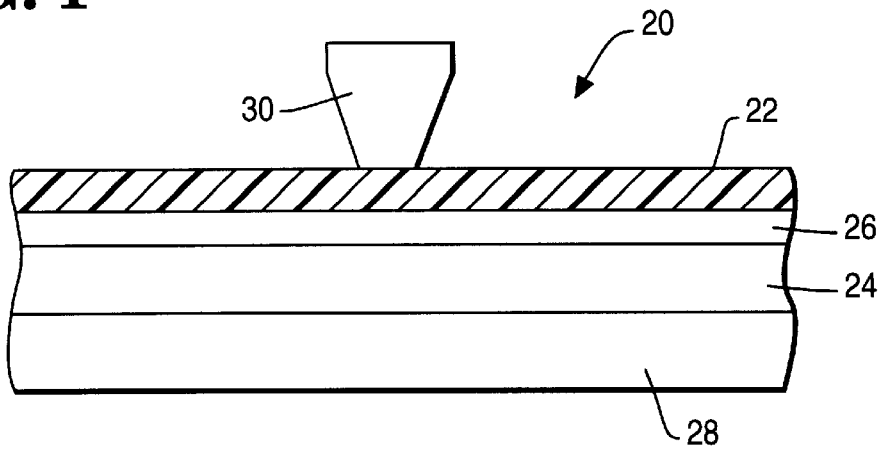
FIG. 1 illustrates a thermal transfer medium of the present invention prior to thermal transfer, which has two thermosoftenable layers.
Figure 2:
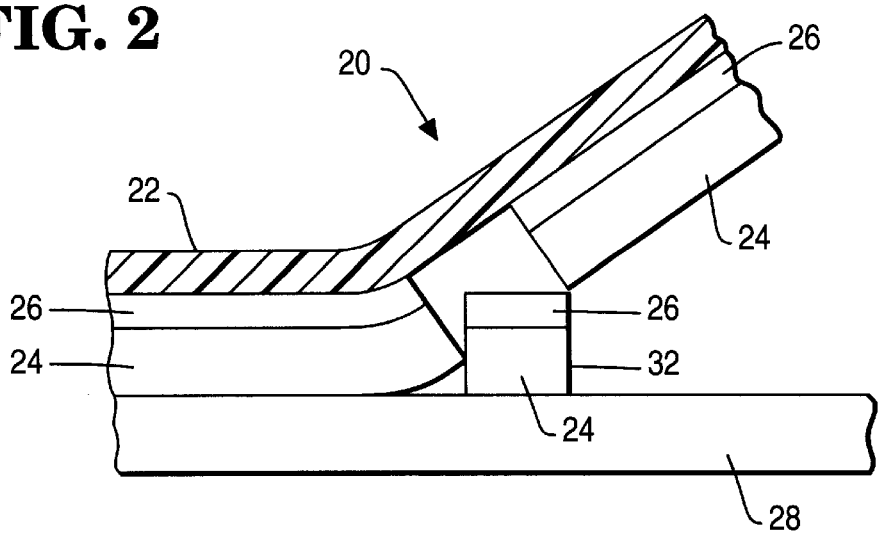
FIG. 2 illustrates a thermal transfer medium of the present invention having two thermosoftenable layers after thermal transfer.

Thermal transfer ribbon 20, as illustrated in FIGS. 1 and 2, is a preferred embodiment of this invention comprising a substrate 22 of a flexible material, preferably a thin smooth paper or plastic-like material. Tissue-type paper material or polyester-type plastic materials are preferred. Positioned on substrate 22 is a thermosoftenable first coating 26 also referred to herein as a "subcoat." The first coating contains a wax (blend), a minor portion of binder resin and optionally a sensible material, e.g., a pigment. The thermal transfer ribbon 20 also has a thermosoftenable second coating 24 positioned on first coating 26 which contains a binder resin with high hot tack properties, a sensible material and a wax. The melt viscosity and thermal sensitivity of the first coating 26 and second coating 24 is determined by the melting points of the binder resins and waxes therein and the amounts thereof in each. The first coating is formulated to have a melt viscosity lower than that of the second coating. With lower melt viscosity values comes lower cohesion within the coating. Lower cohesion allows for easier separation between transferred portions of the coating and the portions which remain on the substrate. Reduced melt viscosity and cohesion ensure that exposure to heat from a thermal transfer head 30 will transfer both the first coating 26 and the second coating 24 to a receiving substrate 28 without splitting the first coating or separating the first and second coatings upon transfer, so as to form a multiple layer image 32.

Low softening points for the first coating also aids in the simultaneous transfer of the first and second coatings. The first coating 26 and second coating 24 have a softening point below 200° C., preferably below 150° C., and most preferably about 75° C. Such softening temperatures enable the thermal transfer medium to be used in high speed thermal transfer printers such as "near edge", "true edge" and "feather edge" thermal transfer printers wherein the thermal transfer ribbon is separated from the receiving substrate almost spontaneously with the firing of the heating elements within the thermal print head. These heating elements (thin film resistors) are believed to operate at temperatures within the range of 100° C. to 300° C. The actual operating temperatures are difficult to determine due to the small size of the heating elements. In preferred embodiments, the first coating has a higher softening temperature than the second coating so that the printed image obtained has higher abrasion/smear resistance. The difference in the softening temperature preferably falls within the range of 0° C.–50° C.

Figure 3:
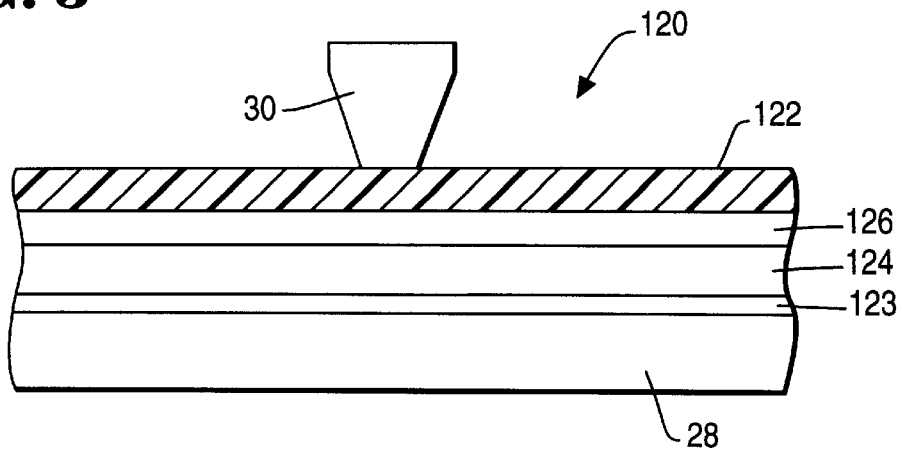
FIG. 3 illustrates another embodiment of a thermal transfer medium of the present invention prior to thermal transfer, which has three thermosoftenable layers.

Thermal transfer ribbon 120, as illustrated in FIG. 3, is another embodiment of this invention comprising a substrate 122 of a flexible material as described above, a thermosoftening first coating 126, a thermosoftening second coating 124 and a thermosoftening third coating 123. The first and second coatings are analogous in composition to coatings 26 and 24 in FIGS. 1 and 2. Third coating 123 serves as a protective layer between the receiving substrate and the second coating which prevents scuffing during printing. Third coating 123 comprises at least 20 wt. % of binder resin with high hot tack properties and wax as in second coating 124 but is preferably free of coloring agent or other sensible material. The properties (viscosity, cohesion and softening point) and composition of third coating 123 are otherwise preferably equivalent to second coating 124.

A unique feature of the thermal transfer media of the present invention is the presence of a sensible material and high level of binder resin with high hot tack properties in the same coating so that this layer functions as both as an adhesive layer and ink layer in a multilayer system. This formulation helps provide better print quality, i.e., reduced offset and darker images in that complete and uniform transfer of the ink layer is simplified due to higher adhesion and proximity to the receiving substrate.

Another feature of the present invention is the differentiation in melt viscosity and cohesion and preferably hot tack properties, between the first coating and second coating with the first coating having a lower melt viscosity and cohesion (and hot tack properties) than that of the second coating. This simplifies separation of the coatings from the flexible substrate of the thermal transfer medium when operating with high speed printers such as "near edge", "true edge" and "feather edge" thermal transfer printers. The features of this multilayered configuration allow the thermal transfer medium to provide high adhesion to the receiving substrate and low adhesion to the flexible substrate, which enhance the performance in high speed printers. This configuration will also provide high quality images on rough receiving substrates (rough stock).

The three layer configuration does not detract from these features but adds the additional feature of providing a protective layer between the ink layer and receiving substrate to prevent scuffing and other machine marks.

The sensible materials employed in the thermal transfer media of this invention are present in the second coating and optionally also in the first coating. The third coating, when used, preferably does not contain any coloring agents or other sensible materials. Essentially, any sensible material suitable for use in thermal transfer printing can be employed in the first or second coatings. These include sensible materials which can be sensed by optical, visual, magnetic means, electroconductive means or by photoelectric means. The most common sensible materials are coloring agents such as colored pigments or dyes and magnetic pigments (e.g., iron oxide). Carbon black is the most common colored pigment. Suitable examples of carbon black include "Raven 1255" provided by Columbian Chemical Company of Atlanta, Ga. Preferred carbon blacks provide thermal transfer media which develop little or no static during use within the thermal transfer medium. The less common coloring agents include those described in U.S. Pat. No. 3,663,278, leuco dyes which can react with phenolic resins to generate color, phthalocyanine dyes, fluorescent naphthalimide dyes, cadmium, primrose, chrome yellow, ultra marine blue, titanium dioxide, zinc oxide, iron oxide, cobalt oxide and nickel oxide. Sensible materials other than coloring agents and magnetic pigments include photochromic dyes, photochromic pigments and fluorescent pigments, which are used in specialized applications.

Photochromic compounds suitable for use in this invention are those classified as organic photochromic compounds. These include the spiro compounds of formula V disclosed by Takahashi et al. in U.S. Pat. No. 5,266,447; the spiroxazine compounds, spiropyran compounds and thiopyran compounds of the formulae in columns 5–6 of U.S. Pat. No. 5,266,447; and also spiro(indoline)naphthoxazine compounds and derivatives thereof, spiro benzoxazine compounds and derivatives thereof, benzopyran compounds and derivatives thereof, naphthopyran compounds and derivatives thereof, benzothioxanthone compounds and derivatives thereof, naphthacenequinone compounds and derivatives thereof and the like.

The second coating may contain a loading of sensible material within the range of 5–50 wt. %, based on dry components. Preferred loadings of sensible material fall within the range of 5–20 wt. % so that the loading of sensible material does not differentiate the second coating from the first coating and inhibit the simultaneous transfer of both coatings to a receiving substrate when exposed to a thermal print head. Where the sensible material is carbon black, the amount employed in the second coating is most preferably about 10 wt. % based on the total weight of dry ingredients of the coating. The first coating is preferably free of sensible material, but, where desired, amounts of 5–15 wt. %, based on total dry ingredients of the coating, are used. Higher loadings of sensible material are not desired due to the increase in viscosity which accompanies high loadings of pigment.

Each of the coatings contain a binder resin which serves to provide flexibility and resiliency to the coatings. The second and third coatings require the use of binder resins with high hot tack properties. Such binder resins are very tacky when softened. This provides higher adhesion to a receiving substrate both during transfer and after transfer by a thermal print head. Binder resins with high hot tack properties include acrylic acid-ethylene-vinyl acetate terpolymers, methacrylic acid-ethylene-vinyl acetate terpolymers, (meth)acrylic acid alkylene alkyl acetate terpolymers, polyvinyl acetate, vinylchloride-vinyl acetate copolymers, ethylene-vinylacetate copolymers, ethylene-ethylacetate copolymers, styrene copolymers, styrene butadiene block copolymers, polyurethane resins, ethylene-alkyl (meth)acrylate copolymers, and styrene-alkyl(meth)acrylate copolymers. Preferred resin binders include polyurethanes, styrene-butadiene block copolymers and ethylene-vinyl acetate copolymers.

Other binder resins which may be present in any one of the coatings include those conventionally employed in thermal transfer media such as those described in U.S. Pat. Nos. 5,240,781 and 5,348,348. These include vinyl chloride polymers, polyethylene, polypropylene, nitrile rubber, acrylic rubber, ethylene-propylene rubber, polyvinyl alcohol, polylactones, polyketones, polystyrene, and ethylene-propylene copolymers. When preparing a thermal transfer ribbon for use with rough stock, higher loadings of binder resin are desired. These resins preferably have a softening temperature of from 80° C. to 250° C. and can be soluble in water or organic solvents or be dispersible in such solvents. To obtain dispersions, the binder resins are used as small particles, preferably of submicron size.

Each coating may contain more than one binder resin to provide a specific property profile. For example, Piccotex 100 resin by Hercules is a styrene copolymer (vinyl toluene-α-methylstyrene copolymer) that provides high hot tack properties desirable for the second coating in aiding adhesion to the receiving substrate upon a transfer. Another high hot tack binder resin that is suitable for the second coating is ethylene-vinylacetate copolymers such as the "Elvax" series by Chemcentral of Atlanta, Ga. These components can be used separately or blended as desired.

The binder resins in the first and second coatings and, where applicable, third coatings can be the same but need not be to obtain excellent performance. While the binder resin in the first coating need not have high hot tack properties, it is preferable to utilize the same binder resin in the first coating and second coating so as to provide similar thermosoftening characteristics. This enables all coatings to respond (soften) uniformly upon being heated by a thermal print head and assists in simultaneous transfer of all coatings to a receiving substrate upon application of heat from the print head of a high speed thermal printer. Where a third coating is used, employing identical resins to the second coating is even more preferred to prevent partial transfer of the second coating.

The coatings also contain wax such as hydrocarbon wax, paraffin wax, carnauba wax, etc. Suitable waxes are those used in conventional thermal transfer media including those described in U.S. Pat. No. 5,240,781. Suitable waxes provide temperature sensitivity and flexibility. Examples include natural waxes such as carnauba wax, rice wax, bees wax, lanolin, candelilla wax, montan wax and ceresine wax; petroleum waxes such a paraffin wax and microcrystalline waxes; synthetic waxes such as oxidized wax, ester wax, low molecular weight polyethylene and Fisher-Tropsch wax; higher fatty acids such as lauric acid, myristic acid, palmitic acid, stearic acid and behenic acid; higher aliphatic alcohols such as stearyl alcohol; esters such as sucrose fatty acid esters, sorbitan fatty acid esters and amides.

The wax-like substances preferably have a melting point of from 40° C. to 130° C., more preferably 65° C. to 110° C. The waxes are differentiated by their softening/melting point. Hard waxes such as carnauba wax, synthetic waxes and montan wax have high softening/melting points and as such, greater resiliency. A particular example of a hard wax is carnauba wax provided by Shamrock Technologies in Newark, New Jersey under the tradename "S-Nauba". Another is "Carnauba North Country No. 3" by Baldini & Co., Inc. of Millburn, N.J. In contrast, soft waxes such as candelilla wax provided by Stahl & Pitch of West Babylon, N.Y., have low melting/softening points and provide greater temperature sensitivity and flexibility. A blend of hard and soft wax is preferred for the first layer. Hard wax typically has a melting point within the range of 80° C.–110° C. and soft wax has a melting/softening point within the range of 40° C.–80° C.

Each coating may contain a plasticizer to enhance flexibility and reduce the softening point. Plasticizers used in binders of conventional thermal transfer ribbons such as those described in U.S. Pat. No. 3,663,278 are suitable. These include adipic acid esters, phthalic acid esters, chlorinated biphenyls, citrates, epoxides, glycerols, glycols, hydrocarbons, chlorinated hydrocarbons, phosphates, and the like. Each layer may contain other optional additives to enhance such properties as flexibility (oil flexibilizers), hot tack properties, cohesion, weatherability (U.V. absorbers), melt viscosity (fillers) and smoothness.

The first coating of the thermal transfer medium of the present invention comprises at least 75 wt. % wax, most preferably more than 90 wt. % wax based on total solids. This high level of wax provides a low melt viscosity and low softening temperature to simplify separation from the flexible substrate of the thermal transfer medium. Blends of waxes are preferred and preferably a blend of hard wax and soft wax is used in ratios ranging from about 2.0:1 to 0.5:1. The first coating also comprises a binder resin, which need not have high hot tack properties. The amount of binder resin employed is less than 20 wt. %, based on total solids to maintain a low melt viscosity value. Preferably, amounts of 3–15 wt. % resin binder are used, based on total dry components (solids). The first coating may optionally contain a sensible material such as a colored pigment. However, such embodiments are not preferred. When used, the amount of pigment preferably ranges from 5–20 wt. %, preferably about 15 wt. %, based on total solid components. The melt viscosity of the first coating can range from 50–1,000 cps, as measured on a Brookfield viscometer (spindle #2) at 100° C. The melting/softening point preferably ranges from 50° to 200° C.

The second coating comprises at least 20 wt. % of a binder having high hot tack properties in addition to sensible material. Preferably, at about 35 wt. % to 50 wt % of the second coating comprises a binder resin having high hot tack properties. To maintain similar softening characteristics consistent with the first coating, the second coating preferably contains at least 25 wt. % wax, preferably about 50 wt. % wax. Other binder resins may be present in minor amounts of preferably about 0–15 wt. %. The melt viscosity of the second layer preferably falls within the range of 5,000 to 30,000 cps as measured on a Brookfield viscometer (spindle #4) at 120° C.

The third coating, when used, preferably does not contain coloring agents or other sensible materials and comprises at least 20 wt. % binder resin having high hot tack properties, which is preferably identical to that within the second coating. Other thermal plastic binder resins and waxes may be employed in amounts which preferably correspond to those given above for the second coating. The third coating softens at a temperature in the range of about 50°–200° C. and preferably has a melt viscosity which ranges from 5,000 to 30,000 cps, as measured on a Brookfield viscometer (spindle #4) at 120° C.

The proportion of resin binder and wax within each of the coatings can be adjusted to control the melt viscosity (cohesion), hot tack, softening temperature, resiliency and other properties. Additives may also be introduced to manipulate these properties. The difference in melt viscosity between the first and second coatings is preferably such that the melt viscosity of the second coating is over 25 times greater than that of the first coating. This will provide reduced cohesion within the first coating, thus simplifying transfer by high speed printers. The second coating preferably has higher hot tack properties to further simplify transfer of both layers to a receiving substrate.

The thermal transfer media of this invention are prepared from coating formulations that contain the above components preferably in solution or dispersion, typically at about 10–60 wt. % solids, preferably 10–25 wt. % solids. Formulations which comprise no solvent (100% solids), referred to herein as "hot melt" formulations, can be used but are not preferred. When employing a solution based coating formulation, a portion of the solvent may remain in the coating applied without significant deleterious effects. The coating formulation can be based on aqueous solvents or organic solvents depending on the solubility of the resin. Suitable organic solvents are mineral spirits or other organic solvent having a boiling point in the range of 110° C.–170° C. such as ketones, ethers, alcohols, substituted and unsubstituted aliphatic hydrocarbons, and substituted and unsubstituted aromatic hydrocarbons. In forming the coating formulation, the resin components may be added to an attritor wherein the solids are ground to a particle size of less than 10 $\mu$m at temperatures not to exceed 120° F. Such particle sizes are typically obtained in about 2 hours at 200–250 rpm.

These coating formulations can be applied to substrates using conventional techniques and equipment such as a Meyer Rod® or like wire round doctor bar set up on a conventional coating machine to provide suitable coat weights. Thermal transfer media of the present invention are obtained via two-layer process wherein the first coating is applied to a substrate such as polyester film as a subcoat and the second coating applied over the first. To prepare a three-layer thermal transfer medium, the third coating is applied over the second after drying. The coat weight of the first coating as preferably maintained between about 1–2 g/m$^2$ and the coat weight of the second coating is preferably maintained between about 1.5–2.5 g/M$^2$. The third coating, when applied, is typically employed at a coat weight between about 0.2–1.5 g/m$^2$. The polyester film is typically from 18–24 gauge; however, the flexible substrates can vary widely and include those described in U.S. Pat. No. 5,348, 348.

The first coating is applied and dried at a temperature of about 150° F.–200° F. Following drying, the second coating is applied at a temperature below the softening point (about 150° F.) to ensure adherence, and dried at a temperature in the range of 140° F.–170° F.

The thermosensitive coatings can be fully transferred to a receiving substrate such as paper or synthetic resin at a temperature in the range of 75° C.–300° C.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

EXAMPLE 1

A coating formulation is prepared by mixing mineral spirits, wax and binder resins in the proportions indicated in Table I, at ambient temperature.

TABLE 1

First Coating Formulation

| Ingredients | Dry % | Wet Weight |
|---|---|---|
| Mineral Spirits[1] | — | 400 |
| Elvax 200W[2] | 06.0 | 0.60 |

TABLE 1-continued

First Coating Formulation

| Ingredients | Dry % | Wet Weight |
|---|---|---|
| Carnauba Wax[3] | 56.4 | 56.4 |
| Candelilla Wax[4] | 37.6 | 37.6 |
| TOTAL | 100.0 | 500.0 |

[1]Mineral Spirits from Ashland Chemical
[2]Elvax 200W from Chemcentral in Atlanta, GA
[3]Carnauba Wax from Strahl & Pitch, West Babylon, NY
[4]Candelilla Wax from Strahl & Pitch, West Babylon, NY A second coating formulation was obtained by combining mineral spirits, binder sin, wax and carbon black in the proportions indicated in Table 2.

TABLE 2

Second Coating Formulation

| Ingredients | Dry % | Wet Range |
|---|---|---|
| Mineral Spirits[5] | — | 400.0 |
| Elvax 200W[6] | 35.0 | 35.0 |
| Candelilla Wax[7] | 55.0 | 55.0 |
| Raven 1255[8] | 10.0 | 10.0 |
| TOTAL | 100.0 | 500.0 |

[5]Mineral Spirits from Ashland Chem.
[6]Elvax 200W from Chemcentral in Atlanta, GA
[7]Candelilla Wax from Strahl & Pitch
[8]Raven 1255 from Cumberland Chem. Co., Atlanta, GA

EXAMPLE OF A THERMAL TRANSFER MEDIUM

A thermal transfer medium consistent with the present invention is prepared as follows: A first coating is formed on a 4.5 $\mu$m polyester film by I.E. DuPont DeNemours & Co. having a coat weight between 1–2 g/m$^2$ from the First Coating Formulation described above by applying said formulation to the substrate with a conventional coating machine at about 150° F.–200° F. and drying at less than 170° F. A second coating having a coat weight within the range of 1.5–2.5 g/m$^2$ is deposited on the dried first coating from the Second Coating Formulation described above with a conventional coating apparatus. The coated polyester film is dried following the application of the second coating at a temperature of about 150° F. to obtain a finished ribbon.

The preceding examples can be repeated with similar success by substituting the generically or specifically described reactants and/or operating conditions of this invention for those used in the preceding example.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermal transfer medium which transfers images to a receiving substrate when exposed to an operating print head of a thermal transfer printer, said thermal transfer medium comprising:

a flexible substrate, a thermosensitive first coating positioned on said substrate comprising at least 75 wt. % of a wax, based on dry components, and 3 to 15 wt. % of a binder resin based on dry components and, optionally, a sensible material in an amount less than 20 wt. % based on dry components, wherein the wax comprises a hard wax and a soft wax in a ratio in the range of 2.0:1 to 0.5:1; and a thermosensitive second coating positioned on said first coating comprising a sensible material, a wax and at least 20 wt. % of a binder resin having high hot tack properties, based on dry components;

wherein a) the melt viscosity of the second coating is 5,000 to 30,000 cps at 120° C. and at least 100 times greater than the melt viscosity of the first coating, b) the hot tack properties and cohesion of the second layer are greater than the hot tack properties and cohesion of the first layer and c) the first coating has a higher softening point than the softening point of the second coating.

2. A thermal transfer medium as in claim 1, wherein the first coating is free of coloring agent.

3. A thermal transfer ribbon which provides printed images on a receiving substrate when exposed to an operating print head of a high speed thermal transfer printer having thin film resistors positioned on the edge of said print head, said thermal transfer ribbon comprising:

A) a polyester substrate,

B) a thermosensitive first coating positioned on said polyester substrate having a coat weight of from 1–2 $g/m^2$ which is free of coloring agent and comprising i) from 20–60 wt. % hard wax and 20–60 wt. % soft wax based on dry components, with a total of at least 75 wt % wax based on dry components, wherein the ratio of hard wax to soft wax falls within the range of 2.0:1 to 0.5:1, and ii) 3–25 wt. % of a binder resin based on dry components; and C) a thermosensitive second coating positioned on said first coating having a coat weight of from 1.5–2.5 $g/m^2$ comprising 5–25 wt. % coloring agent, about 20–60 wt. % of a binder resin having high hot tack properties, all based on dry components, and 20–60 wt. % of wax, all based on dry components, wherein (a) the first coating has a melt viscosity at least 100 times lower than the melt viscosity values for the second coating, wherein the second coating has a melt viscosity of from 5000 to 30,000 cps at 120° C. (b) the second coating has higher hot tack properties and cohesion than the first coating and (c) the first coating has a higher softening point than that of the second coating, wherein the second coating has a softening point in the range of 50° C. to 200° C. and the coat weight for the first and second coatings are selected to provide complete transfer of both the first and second coatings when exposed to an operating print head of a high speed thermal printer.

4. A thermal transfer medium as in claim 3, wherein the first coating contains the same binder resin having hot tack properties as within the second coating.

5. A thermal transfer medium as in claim 3, wherein the first coating contains a different binder resin having hot tack properties than in the second coating.

6. A thermal transfer ribbon as in claim 3, wherein the binder resin with high hot tack properties is selected from the group consisting of ethylene-vinylacetate copolymers, polyurethanes and styrene-butadiene block copolymers.

7. A thermal transfer ribbon as in claim 3, wherein the hard wax is carnauba wax and the soft wax is candelilla wax.

8. A thermal transfer ribbon which provides printed images on a receiving substrate when exposed to an operating print head of a thermal transfer printer, said thermal transfer ribbon comprising:

a polyester substrate, a thermosensitive first coating positioned on said polyester substrate having a coat weight of from 1–2 $g/m^2$ which is free of coloring agent and comprising i) from 20–60 wt. % hard wax, 20–60 wt. % soft wax with a total of at least 75 wt % wax based on dry components, wherein the ratio of hard wax to soft wax falls within the range of 2.0:1 to 0.5:1, and ii) 3–25 wt. % of a binder resin, all based on dry components;

a thermosensitive second coating positioned on said first coating having a coat weight of from 1.5–2.5 $g/m^2$ comprising 5–25 wt. % coloring agent, about 20–60 wt. % of a binder resin having high hot tack properties, all based on dry components, and 20–60 wt. % of wax, and a third coating positioned on top of said second coating, said third coating having a coat weight within the range of 0.2–1.5 $g/m^2$ and comprising a binder resin having high hot tack properties in an amount of at least 20 wt. % based on dry components and a wax and said third coating being free of coloring agent, and wherein (a) the first coating has a melt viscosity at least 100 times lower than the melt viscosity values for the second coating, (b) the second coating has higher hot tack properties and cohesion than the first coating and (c) the first coating has a higher softening point than that of the second coating.

* * * * *